US009872589B2

(12) United States Patent
Granger

(10) Patent No.: US 9,872,589 B2
(45) Date of Patent: Jan. 23, 2018

(54) DEVICE FOR DISPENSING PRE-CUT ROLLED WIPING MATERIAL

(76) Inventor: Maurice Granger, St. Priest en Jarez (FR)

( * ) Notice: Subject to any disclaimer, the term of this patent is extended or adjusted under 35 U.S.C. 154(b) by 111 days.

(21) Appl. No.: 14/002,902

(22) PCT Filed: Feb. 9, 2012

(86) PCT No.: PCT/FR2012/050278

§ 371 (c)(1),
(2), (4) Date: Sep. 3, 2013

(87) PCT Pub. No.: WO2012/168581

PCT Pub. Date: Dec. 13, 2012

(65) Prior Publication Data

US 2013/0334272 A1 Dec. 19, 2013

(30) Foreign Application Priority Data

Mar. 3, 2011 (FR) ..... 11 51715

(51) Int. Cl.
*A47K 10/32* (2006.01)
*A47K 10/36* (2006.01)
*A47K 10/38* (2006.01)

(52) U.S. Cl.
CPC ..... *A47K 10/3643* (2013.01); *A47K 10/38* (2013.01); *A47K 10/3827* (2013.01);
(Continued)

(58) Field of Classification Search
CPC .. A47K 10/18; A47K 10/185; A47K 10/3827; A47K 2010/3233;
(Continued)

(56) References Cited

U.S. PATENT DOCUMENTS 1,135,658 A 4/1915 Brown et al.
2,273,384 A 2/1942 Steiner et al.
(Continued)

FOREIGN PATENT DOCUMENTS

EP 0 034 121 B1 8/1981
EP 0 387 160 B1 9/1990
(Continued)

*Primary Examiner* — William E Dondero
*Assistant Examiner* — Nathaniel L Adams

(57) ABSTRACT

The device for dispensing pre-cut rolled wiping material comprising a housing receiving a roll of wiping material, said housing comprising a back wall, and two lateral walls, said walls forming external walls of the housing, said housing receiving a flap hinged with respect to the housing, ensuring the guiding and the unwinding of the roll of material, and a cover hinged with respect to the housing, defining after closing a space between said flap and said cover to enable the strip of material to come out, said flap and said cover defining a space between them to ensure the guiding and the letting out of the strip of material and the separation of a format of material, said device being remarkable in that it has an external wall for supporting the roll of material having a profile comprising a horizontal central portion and, on either side, two raised front and back oblique portions enabling to receive, to center, and to hold in a stabilized way the roll of material, and in that the front oblique portion is, by its lower portion, jointed to the horizontal support portion, and recessed with respect to the front end of the housing to define a volumetric space with the flap, allowing the user to engage and to position his fingers to grab the unwound strip of material coming from the roll for the distribution of a cut format of material.

11 Claims, 8 Drawing Sheets

(52) U.S. Cl.
CPC ..... *A47K 2010/3253* (2013.01); *Y10T 225/21* (2015.04); *Y10T 225/211* (2015.04); *Y10T 225/294* (2015.04)

(58) Field of Classification Search
CPC ..... A47K 10/3643; A47K 10/38; A47K 2010/3253; Y10T 225/21; Y10T 225/211; Y10T 225/294
See application file for complete search history.

(56) References Cited

U.S. PATENT DOCUMENTS

| | | | | |
|---|---|---|---|---|
| 2,590,718 | A | 3/1952 | Lundquist | |
| 2,683,641 | A * | 7/1954 | Larson | 225/46 |
| 2,832,549 | A | 7/1954 | Youngberg | |
| 2,695,208 | A | 11/1954 | Graham | |
| 4,165,138 | A | 8/1979 | Hedge et al. | |
| 4,294,389 | A * | 10/1981 | Falk | A47K 10/3827 225/34 |
| 4,389,026 | A | 6/1983 | Willa et al. | |
| 4,467,974 | A * | 8/1984 | Crim | 242/419.4 |
| 4,611,768 | A | 9/1986 | Voss et al. | |
| 5,207,633 | A | 5/1993 | Granger | |
| 5,335,811 | A | 8/1994 | Morand | |
| 5,897,074 | A | 4/1999 | Marino | |
| 6,202,956 | B1 * | 3/2001 | Grasso et al. | 242/560 |
| 6,736,348 | B1 | 5/2004 | Formon et al. | |
| 7,040,567 | B1 * | 5/2006 | Lewis et al. | 242/588.3 |
| 7,093,737 | B2 | 8/2006 | Tramontina et al. | |
| 8,191,736 | B2 | 6/2012 | Beranger | |
| 8,672,255 | B2 | 3/2014 | Granger | |
| 2010/0001015 | A1 | 1/2010 | Thoren et al. | |
| 2011/0089213 | A1 | 4/2011 | Granger | |
| 2011/0101020 | A1 | 5/2011 | Granger | |
| 2011/0174833 | A1 | 7/2011 | Granger | |
| 2011/0284861 | A1 | 11/2011 | Granger | |
| 2013/0256450 | A1 | 10/2013 | Granger | |
| 2013/0277492 | A1 | 10/2013 | Granger | |
| 2013/0320132 | A1 | 12/2013 | Granger | |

FOREIGN PATENT DOCUMENTS

| | | | | |
|---|---|---|---|---|
| FR | 957 096 | | 10/1947 | |
| FR | 1 060 322 | | 4/1952 | |
| FR | 1 058 449 | | 3/1954 | |
| FR | 1 058 471 | | 3/1954 | |
| FR | 1 059 244 | | 3/1954 | |
| FR | 2 931 350 | A1 | 11/2009 | |
| FR | 2932671 | A1 * | 12/2009 | A47K 10/424 |
| FR | 2 960 760 | A1 | 12/2011 | |
| FR | 2 966 034 | A1 | 4/2012 | |
| FR | 2 968 530 | A1 | 6/2012 | |
| FR | 2 970 167 | A1 | 7/2012 | |
| FR | 2 983 694 | A1 | 6/2013 | |
| WO | 2009/150342 | A2 | 12/2009 | |
| WO | 2009/150351 | A1 | 12/2009 | |
| WO | 2010/007261 | A1 | 1/2010 | |
| WO | 2010/034915 | A1 | 4/2010 | |
| WO | 2010/063917 | A1 | 6/2010 | |
| WO | 2010/089467 | A1 | 8/2010 | |

* cited by examiner

Fig. 9
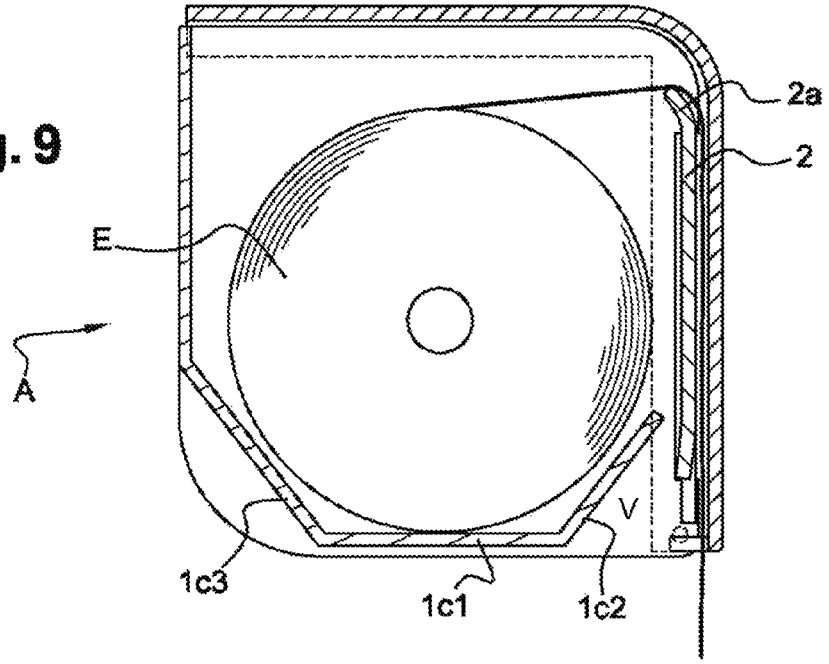
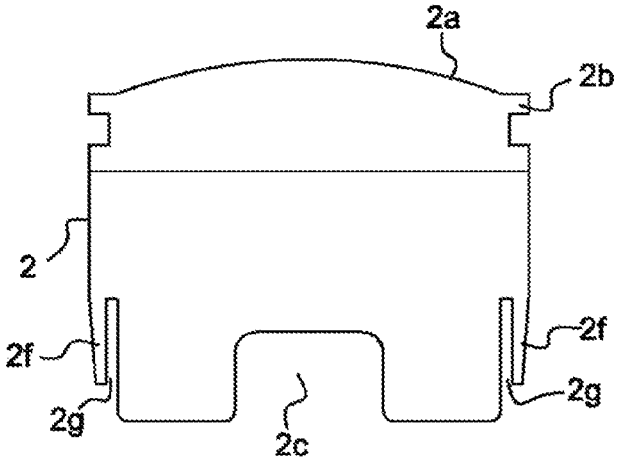
Fig. 10
Fig. 11
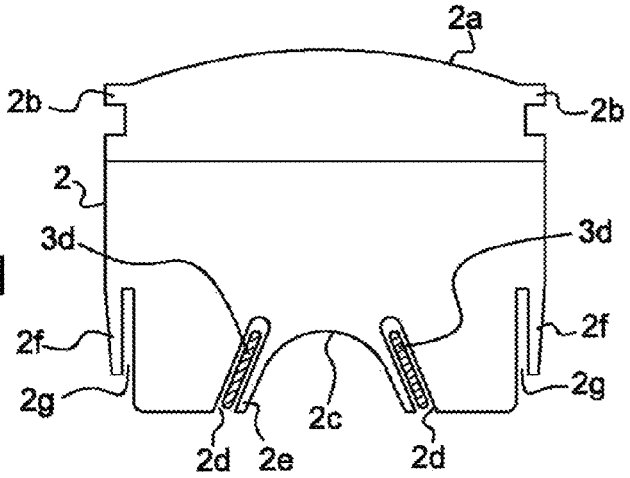

DEVICE FOR DISPENSING PRE-CUT ROLLED WIPING MATERIAL

BACKGROUND

Technical Field

The present disclosure relates to the technical field of devices for dispensing wiping materials such as hand wipes, toilet paper, and the like.

Description of the Related Art

The Applicant has designed and developed many dispensing devices providing pre-cut wiping materials.

Different technical solutions have thus been provided, which have been described in the Applicant's patents, identified as follows:

WO 2010/089467 and its development FR 1058449, WO 2010/063917, WO 2010/034915, WO 2010/007261, WO 2009/150342, FR 1058471, FR 1059244, FR 1060322.

Generally, such devices have a housing for receiving the wiping material, from which is attached a pivoting flap ensuring the guiding, by its curved upper portion, of the pulled strip of material, as well as a cover hinged to the housing, which may be fitted with complementary means cooperating with shapes provided on said flap to ensure the letting out of the pulled strip of material and the cutting thereof.

BRIEF SUMMARY

The problem that the present invention aims at solving is to simplify a dispensing device of this type and to decrease the bulk thereof.

The Applicant has desired to further optimize the design of the dispensing device by allowing a stable positioning of the roll of material arranged at the bottom of the housing and also to ease the grabbing of said strip of material by the operator to obtain a flat pre-cut format of strip of material.

The Applicant has also desired to improve the accessibility to the strip of material for its manual grabbing by the operator, but also, in case of a jamming on passing of the strip of material between the flap and the cover, to enable the unjamming of said material.

Based on this reflection, the Applicant has also searched, based on the same technical concept, for an embodiment of the dispenser to dispense wiping material from a single roll of material, or from two rolls of material, one being in service, the other one being a reserve roll, to increase the device usage capacity. This complementary approach has also been developed in the forming of a simple and easy-to-use device, with a minimum number of components, and while enabling to select the strip of wiping material to be pulled in the best conditions.

According to a first feature of the invention, the device for dispensing pre-cut rolled wiping material comprising a housing receiving a roll of wiping material, said housing comprising a back wall and two lateral walls, said walls forming external walls of the housing, said housing receiving a flap hinged with respect to the housing, ensuring the guiding and the unwinding of the roll of material, and a cover hinged with respect to the housing, defined after closing a space between said flap and said cover to enable the strip of material to come out, said flap and said cover defining a space between them to ensure the guiding and the letting out of the strip of material and the separation of a format of material, said device being characterized in that it has an external wall for supporting the roll of material having a profile comprising a horizontal central portion and, on either side, two raised front and back oblique portions enabling to receive, to center, and to hold in a stabilized way the roll of material, and in that the front oblique portion is, by its lower portion, jointed to the horizontal support portion, and recessed with respect to the front end of the housing to define a volumetric space with the flap, allowing the user to engage and to position his fingers to grab the unwound strip of material coming from the roll for the distribution of a cut format of material.

According to another feature, the dispensing device is remarkable in that it comprises two compartments separated by a transverse plate having the flap bearing against it, and in that the flap and the cover have central openings in front of each compartment for receiving a roll of wiping material.

The foregoing and other features will appear from the following description.

BRIEF DESCRIPTION OF THE SEVERAL VIEWS OF THE DRAWINGS

The object of the invention is illustrated as a non-limiting example in the drawings, where:

FIG. 9 is a cross-section view of the dispensing device such as illustrated in FIG. 7 showing the dispensing of the strip of material, FIG. 10 is a front view of the flap in an alternative embodiment, FIG. 11 is a front view of the flap in another alternative embodiment.

DETAILED DESCRIPTION

Figure 1:
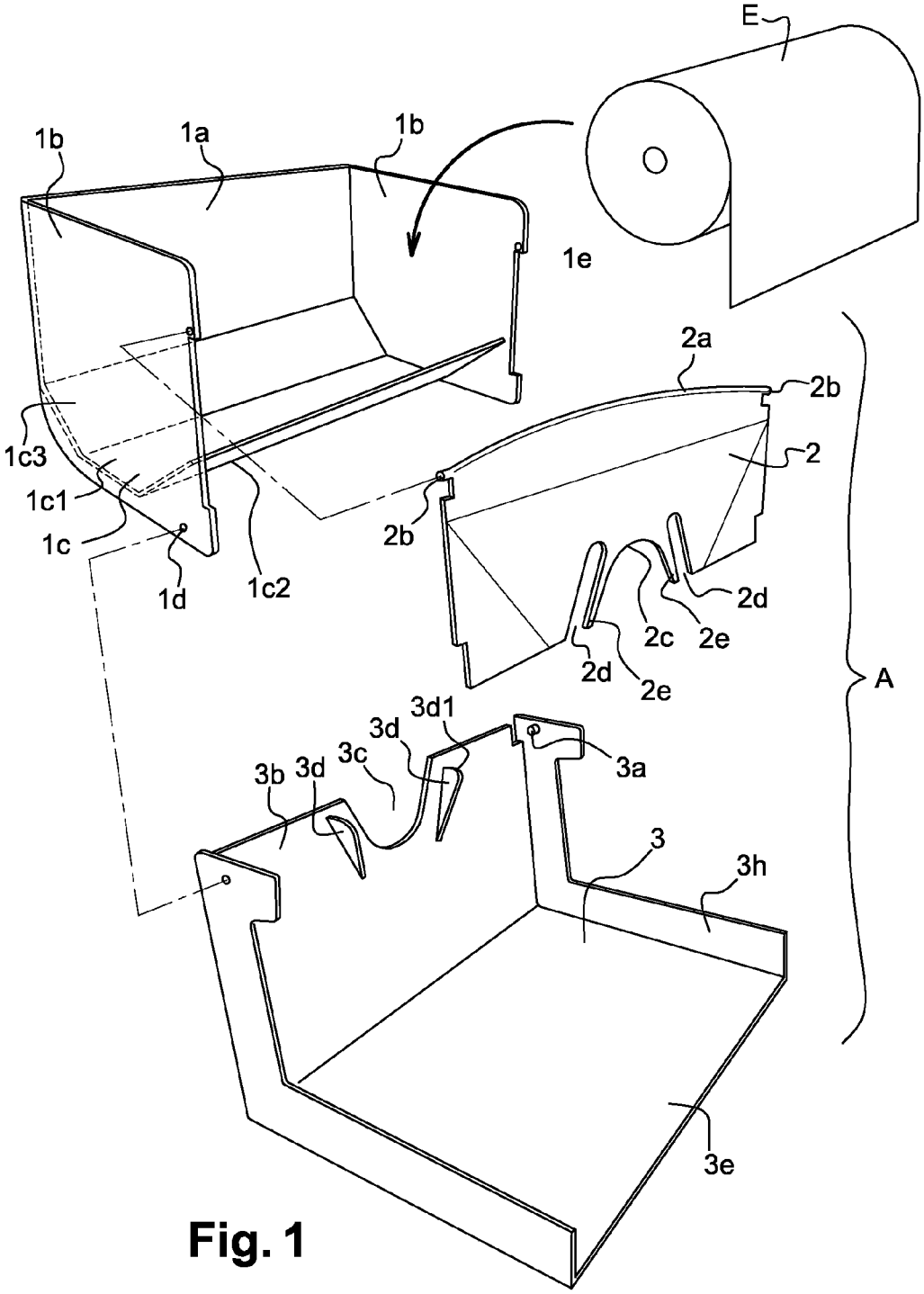
FIG. 1 is a perspective view of a dispensing device according to the invention before assembly of its components and positioning of a roll of pre-cut material wound in a roll.
Figure 2:
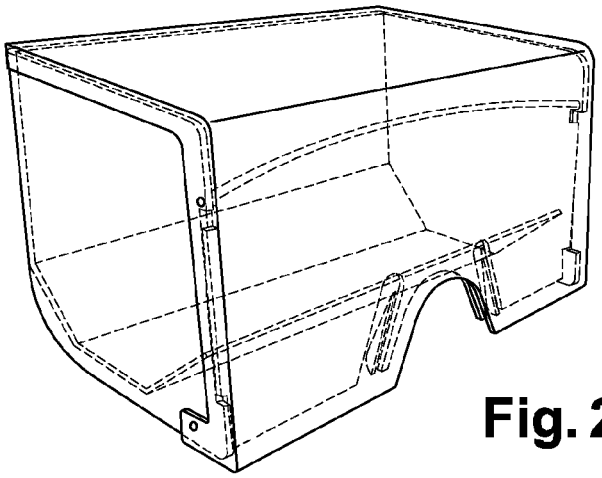
FIG. 2 is a view of the dispensing device in closed position, where the roll of material is not shown.
Figure 3:
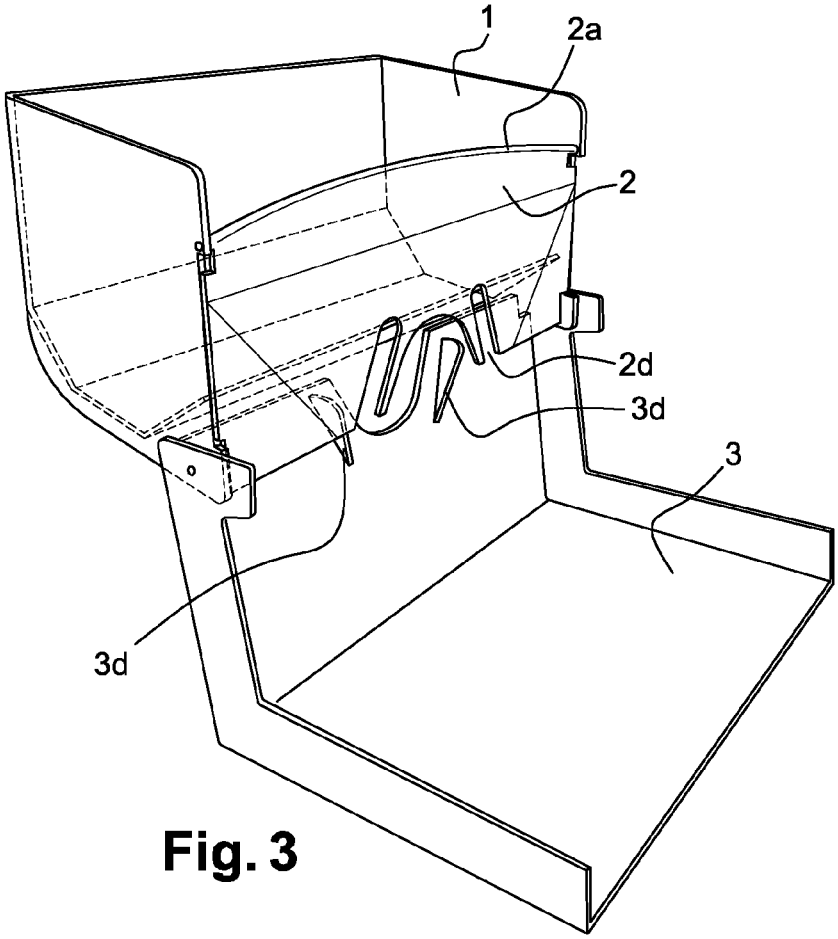
FIG. 3 is a view according to FIG. 2 of the device, the cover being open, where the roll of material is not shown.
Figure 4:
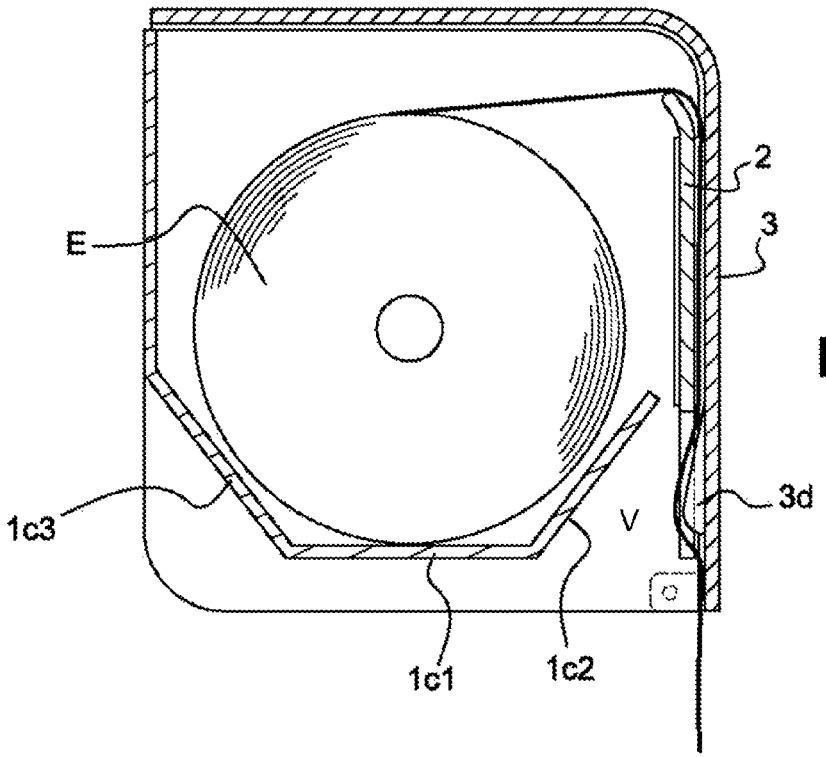
FIG. 4 is a cross-section view of the dispensing device according to FIG. 1 illustrating after closing of the cover the dispensing of the strip of wiping material.
Figure 5:
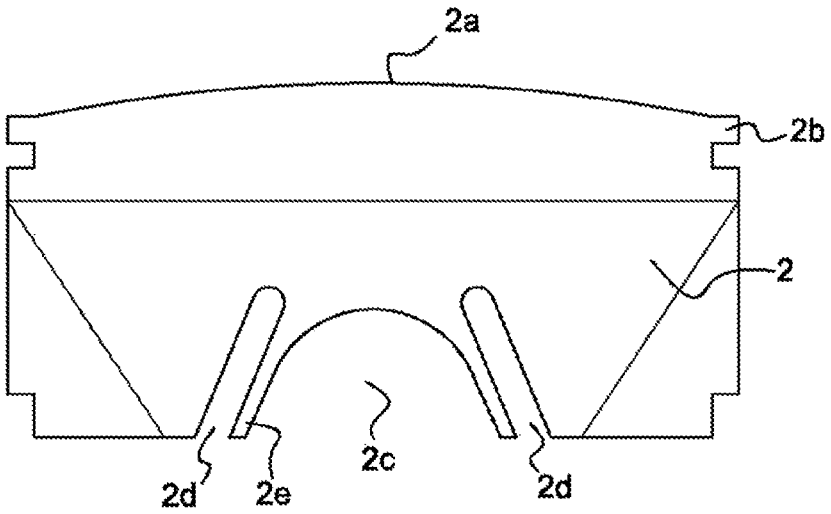
FIG. 5 is a view of an embodiment of the flap, in a first embodiment.

To make the object of the invention more tangible, it is now described in a non-limiting way illustrated in the drawings.

The pre-cut wiping material dispenser is designated with general reference (A). The wiping material (E) appears in a roll and may find applications as a hand wipe, toilet paper, household roll towels and, more generally, such a wiping material for sanitary purposes is intended to be used in public premises or for a private use by consumers or in organization, such as, for example, hospitals, clinics, or the like, or may be used in other industrial applications.

The device thus comprises a housing (1) comprising a back wall (1*a*) two lateral walls (1*b*) and a wall for supporting (1*c*) the roll of material (E). The housing receives a hinged flap (2) ensuring the guiding and the unwinding of the roll of material. A cover (3) is hinged with respect to the housing by axes (3*a*) cooperating with openings (1*d*) formed on the lateral walls (1*b*) of the housing.

According to the invention, the wall (1*c*) for supporting the roll of material has a horizontal portion (1*c*1) and, on either side, two front and back oblique portions (1*c*2) and (1*c*3) having a same inclination, thus enabling to receive and to center the roll of material. Front oblique portion (1*c*2) is jointed by its lower portion to the horizontal central portion (1*c*1) recessed with respect to the front end of the housing to define a volumetric space (V) with the flap (2) enabling the operator to engage and to position his fingers in order to grab the strip of material unwound from the roll. In other words, the roll of material (E) is properly centered and positioned on the horizontal support portion (1*c*1), thus enabling to control its position and avoiding any rocking. The oblique portions (1*c*2) (1*c*3) are inclined with respect to the horizontal portion (1*c*1) according to an angulation a approximately ranging from 30 to 60°. The volumetric space (V) is thus particularly large with respect to the positioning of the flap (2), which is located at the front of the housing. This space has a substantially triangular configuration along the entire length of the device housing.

The flap (2) has an upper profile (2*a*) of curved configuration with, at its end, two fingers (2*b*) capable of engaging into openings (1*e*) formed on the lateral walls of the housing. In the implementation illustrated in FIG. 1, the flap (2) has in its lower portion a central opening (2*c*) of substantially circular configuration with a very deep oblique slot (2*d*) on either side. They thus define, between the opening (2*c*) and the slots (2*d*), a tab (2*e*). The flap (2) may have a flat shape or may be provided with bulged areas as described in one of the previous patents of the Applicant.

The cover (3) comprises a locking device known per se, not shown, to be fastened to the housing. The cover has on its wall (3*b*) opposite to the flap (2) a central opening (3*c*) of same configuration as opening (2*c*), and on either side of said opening (3*c*), protruding ribs (3*d*) which are capable of penetrating into the slots (2*d*). The ribs have a tear drop configuration, with a rounded shape (3*d*1) located close to the lower end of the lower portion of the cover. Portion (3*b*) of the cover is continued by a wall (3*e*) covering the housing, this wall being capable of having a curved profile or of having a configuration with different faces as shown in FIG. 1.

Figure 6:
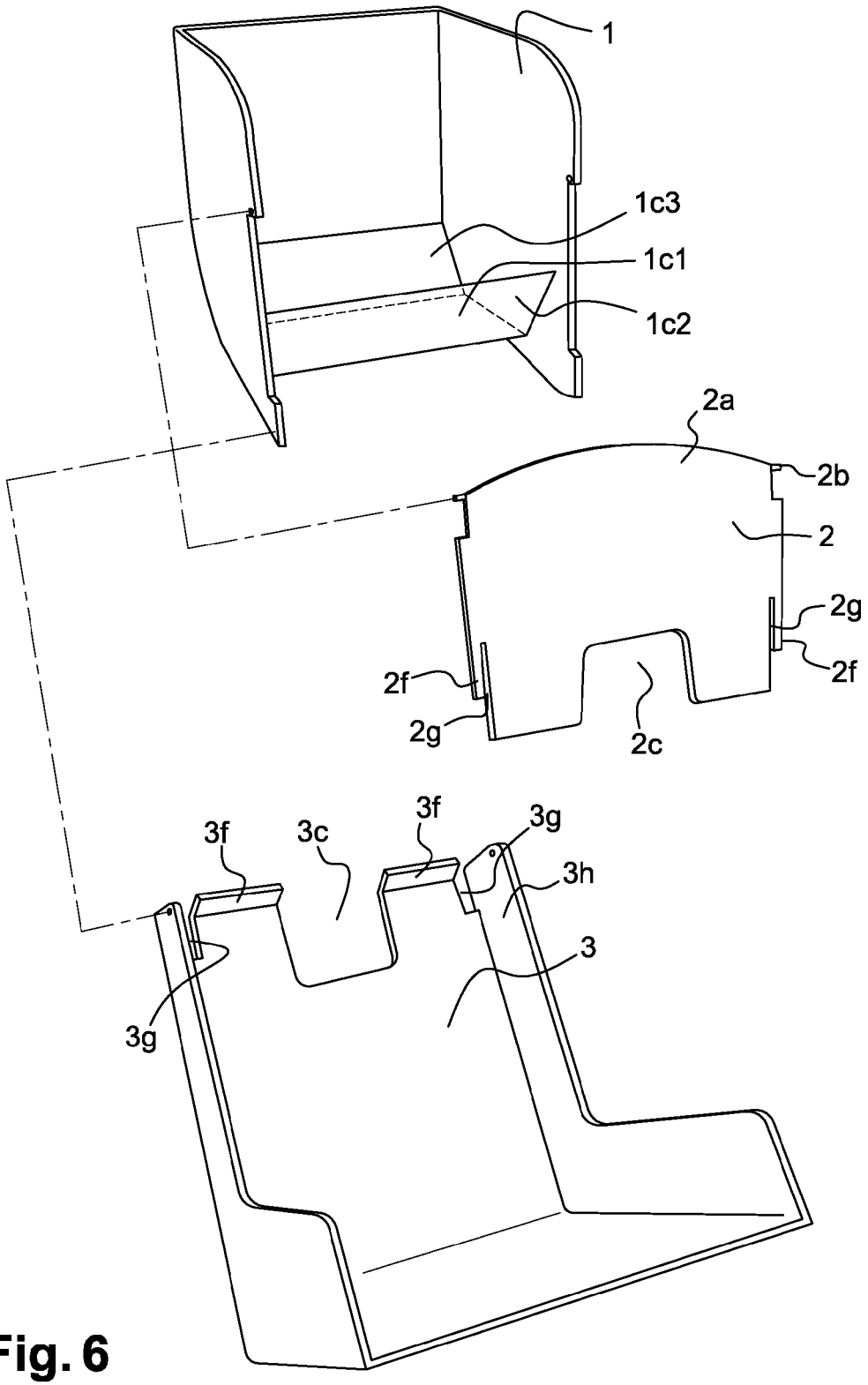
FIG. 6 is a view of a variation of the dispensing device according to the invention.

In the variation of FIG. 6, the housing remains identical to that described previously. The flap (2) has the same configuration, except for the slots (2*d*), which are replaced with end tabs (2*f*) formed close to the edges of said flap with slots (2*g*) between the tabs (2*f*) and the flap wall, said slots (2*g*) contributing to provide resilience to the flap on pulling of the strip of material.

The cover (3) in this specific configuration has, on either side of the central opening (3*c*), folded portions (3*f*) behaving as stops for the wiping material. Slots (3*g*) are formed between the portions (3*f*) forming stops and the lateral walls (3*h*) of the cover.

Figure 7:
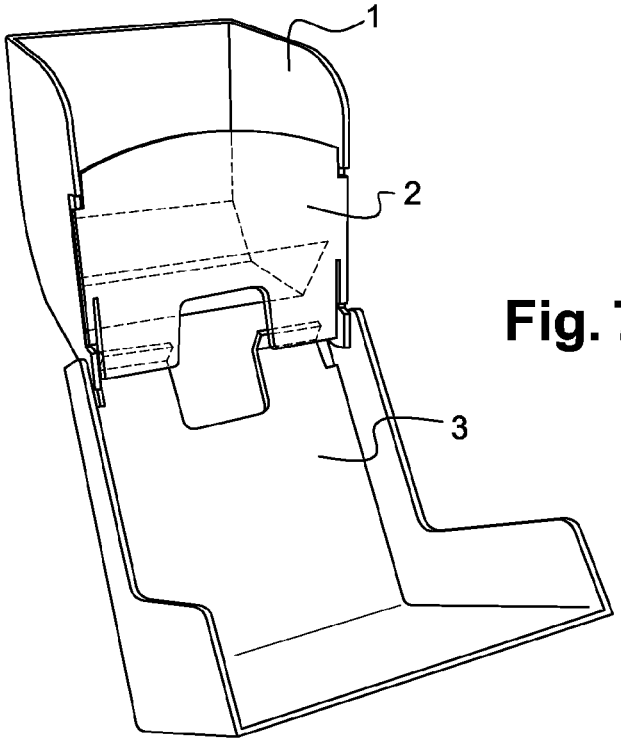
FIG. 7 is a view of the dispensing device in opened position after assembly according to FIG. 6.
Figure 8:
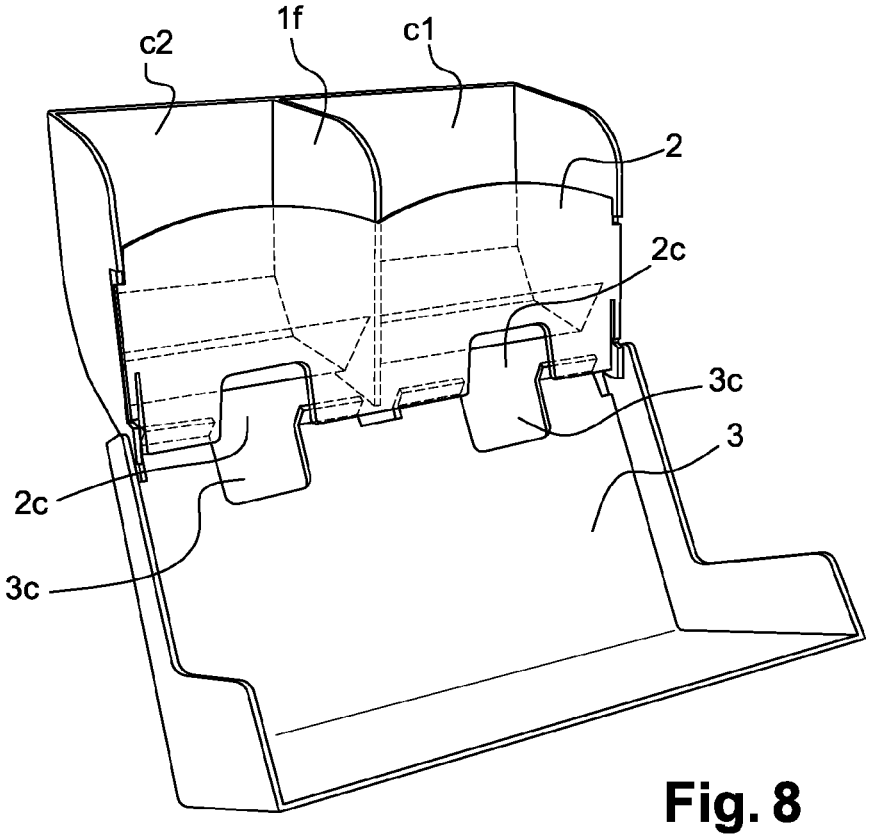
FIG. 8 is a view of a variation of the dispensing device fitted with two compartments enabling to dispense a strip of material from two different rolls.
Figure 12:
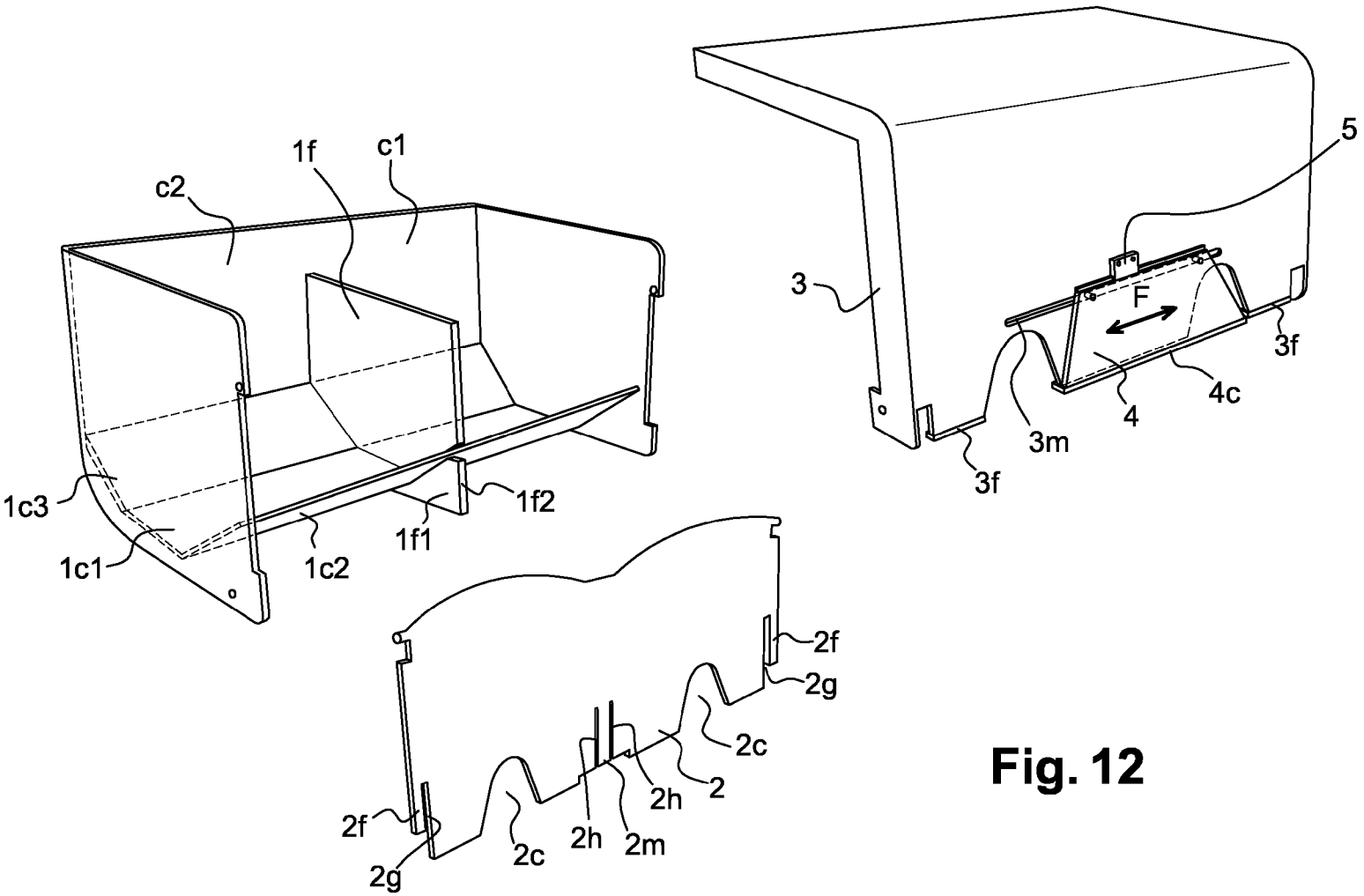
FIG. 12 is a view of a dispensing device according to the invention, with two compartments and a selector device for controlling the dispensing from one of the two rolls.
Figure 13:
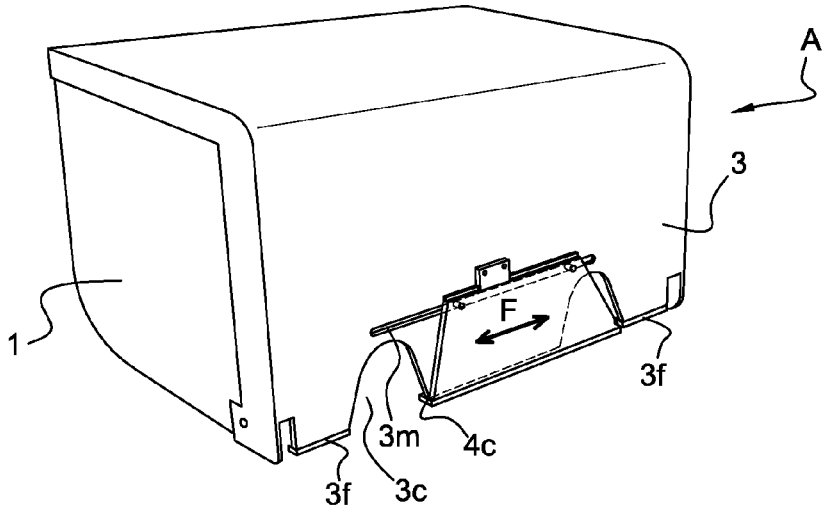
FIG. 13 is a view of the dispensing device according to FIG. 12 in closed position.
Figure 14:
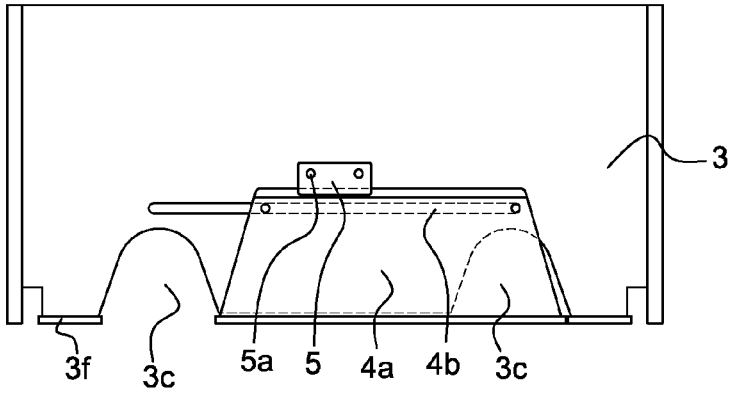
FIGS. 14 and 15 are front views illustrating the positioning of the selector device according to the roll of material to be unwound.
Figure 15:
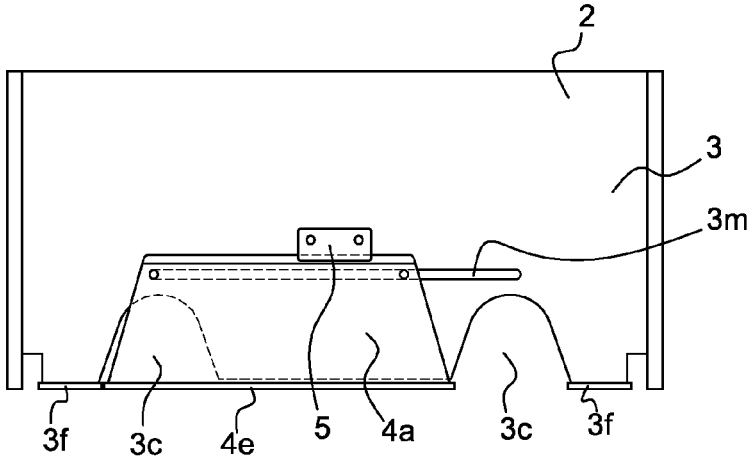

FIG. 8 shows a variation of the device identified in FIGS. 6 and 7 with the fitting, in this case, of two compartments (c1) and (c2) separated by a transverse plate (1*f*). There thus are two compartments for receiving two rolls of wiping material, two flaps (2) independent from each other, and a single cover (3) for covering the entire housing on closing of the device. In this configuration, the cover has two openings (3*c*) which are intended to be located opposite to each opening (2*c*) formed on each of the flaps.

FIGS. 10 and 11 show two specific flap shapes.

The flap shown in FIG. 10 corresponds to that identified in FIG. 6. The flap shown in FIG. 11 comprises, on either side of its central opening (2*c*), two slots (2*d*) delimiting two tabs (2*e*) for allowing the passage of the ribs (3*d*) formed on the cover. At its end, the flap has tabs (2*f*) and slots (2*g*) such as described previously. Referring to FIGS. 12 to 15, the wiping material dispenser has been shown in a configuration with two compartments (c1) (c2) separated by a transverse plate (1*f*). It comprises the support portion (1*c*) such as defined previously. The transverse plate (1*f*) located inside of the housing volume extends substantially outwards beyond the front portion (1*c*2) by forming a protruding portion (1*f*1) with a front edge (1*f*2) forming a bearing stop. In this embodiment, the flap (2) comprises between central openings (2*c*) two parallel slots (2*h*) delimiting a tab (2*m*) between them, said tab being capable of bearing against the edge (1*f*2) of the transverse plate. The two slots (2*h*) contribute to providing resilience to each corresponding portion of the flap of each compartment (c1) or (c2).

Further, and in an optimized embodiment of the invention, the cover (3) is fitted to receive a selector (4) sliding on the outside with respect to the cover (3) and arranged to horizontally move in order to close, now the opening (2*c*) of the flap in relation with compartment (c1) of the housing, now the opening (2*c*) in relation with compartment (c2) of the housing, and this, in an alternating back and forth motion along the direction indicated by arrow (f). For this purpose, the cover is provided with a very long horizontal recess (3*m*) allowing the alternating motion of said selector (4). The latter thus comprises a plate of vertical trapezoidal configuration (4*a*) with a beading (4*b*) in its upper portion, capable of displacing within the recess (3*m*). An upper stop part (5) enables to control the displacement of the selector by being maintained in vertical position. Either the stop part (5) is assembled and attached by means (5*a*) on the cover, or the cover and this part (5) are formed in one piece on manufacturing. The selector (4) further has in its lower portion an inner leg (4*c*) which continues the stop parts (3*f*) formed on the cover. The trapezoidal configuration of the selector enables to totally close, to the right or the left, one of the openings (2*c*) formed on the flap (2). It can thus be understood that the operator selects the roll of material to be unwound by a simple horizontal manipulation of the selector along the direction indicated by the arrow (F).

The solution provided by the Applicant provides a dispensing device of very simple design with only three or four components, according to the presence or not of the selector (4), that is, the housing (1), the flap (2), the cover (3). In all embodiments, whatever the configuration of the flap, several variations of which have been illustrated, the dispensing device, due to the specific shape of the portion for receiving the roll of material, provides an easy access for the operator's fingers into the volumetric space (V) which has been defined with the flap (2). In all cases, the grabbing of the strip of material is extremely easy, with no risk of wounding the fingers of the operator's hand, the material being dispensed flat.

The invention claimed is:

1. A device for dispensing pre-cut rolled wiping material, comprising:

a housing configured to receive a roll of wiping material, said housing comprising a back wall, two lateral walls, and a bottom wall forming external walls of the housing;

a flap hinged with respect to the housing and capable to guide the roll of wiping material during unwinding; and a cover hinged with respect to the housing, wherein after closure of the cover, said flap and said cover define a first space therebetween to allow a strip of wiping material to pass therethrough, the strip of wiping material being separated from the roll of wiping material in said first space;

wherein for supporting the roll of wiping material, the bottom wall is integrally formed comprising a horizontal central portion, a front oblique portion, and a back oblique portion;

wherein the front oblique portion and the back oblique portion are raised on either side of the horizontal central portion to receive, center, and stabilize the roll of wiping material;

wherein the front oblique portion includes a lower portion which extends from the horizontal central portion and is spaced apart with respect to a front bottom end of the housing, the front oblique portion and the flap defining a second space therebetween at a front bottom end of the device, said second space being located rearward with respect to said first space and downward with respect to at least a top portion of said first space, the strip of wiping material exiting the device through a lower portion of said first space and which lower portion of said first space is proximal to said second space for distribution of the wiping material; and wherein the first space includes an entry and an exit and is defined in part by a single, substantially planar external surface of the flap spaced apart from an internal surface of the cover, the single, substantially planar external surface extending from proximal to the entry to proximal to the exit, wherein the single, substantially planar external surface is defined at least in part by a middle portion having a first plane and a lower portion located adjacent to an upper edge of a central opening of the flap, the lower portion extending between two opposing side edges of the flap and having a second plane, the first plane and the second plane being substantially co-planar.

2. The dispensing device of claim 1, wherein the front oblique portion and the back oblique portion are inclined with respect to the horizontal central portion according to an angulation a ranging from 30° to 60°, and wherein the second space is located at the front bottom end of the housing and includes a substantially triangular configuration along an entire length of the housing.

3. The dispensing device of claim 1, wherein the flap has a curved upper profile and includes the lower portion having the central opening, the central opening of the flap defining at least one circular central opening.

4. The dispensing device of claim 3, wherein the flap has, on either side of the circular central opening, oblique slots with tabs for cooperating and allowing nesting of complementary shapes provided on the cover on either side of a central opening formed on said cover.

5. The dispensing device of claim 3, wherein the flap has a main body and end tabs formed next to edges of the main body, with slots arranged between the end tabs and the main body, said slots contributing to provide resilience to the flap.

6. The dispensing device of claim 3, wherein the cover has, on either side of a central opening, folded stop portions and slots formed between the folded stop portions and lateral portions of said cover.

7. The dispensing device of claim 1, wherein the device comprises two compartments, each compartment configured to receive the roll of wiping material, wherein the two compartments are separated by a transverse plate, the flap bearing against the transverse plate, and wherein the central opening of the flap includes a first central opening and a second central opening, and the cover includes a first central opening and a second central opening, the first and the second central openings of the respective flap and cover located in front of each of the two compartments.

8. The dispensing device of claim 7, wherein the transverse plate extends outwards beyond the front oblique portion by forming a protruding portion with a front edge forming a bearing stop, and wherein the flap comprises, between the central openings, two parallel slots delimiting a tab capable of bearing against the front edge.

9. The dispensing device of claim 7, wherein the cover is fitted to receive a selector sliding outside the device with respect to the cover and arranged to horizontally move in an alternative back and forth motion in order to close either the first central opening of the flap located in front of a first one of the two compartments, or the second central opening of the flap located in front of a second one of the two compartments.

10. The dispensing device of claim 9, wherein the selector comprises a vertical plate of trapezoidal configuration and having an upper portion provided with a beading movable within a recess of the cover, and wherein an upper stop part fixed with respect to the cover controls displacement of the selector, and wherein the selector further has a lower portion including an inner leg which is configured to align with folded stop portions formed on the cover.

11. The dispensing device of claim 1, wherein the horizontal central portion, the front oblique portion and the back oblique portion form a bottom part of the bottom wall and are spaced upwards with respect to lateral bottom ends of the two lateral walls of the housing.

* * * * *